US006854256B2

(12) United States Patent
Wassenhoven et al.

(10) Patent No.: US 6,854,256 B2
(45) Date of Patent: Feb. 15, 2005

(54) SPINNING DEVICE

(75) Inventors: Heinz-Georg Wassenhoven, Mönchengladbach (DE); Michael Spitzer, Korschenbroich (DE); Dieter Haaken, Erkelenz (DE); Harry Gatzke, Mönchengladbach (DE); Detlef Schelter, Herzogenrath (DE); Elisabeth Klaczynski, Wegberg (DE); Hans-Josef Schröder, Mönchengladbach (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 10/389,200

(22) Filed: Mar. 14, 2003

(65) Prior Publication Data

US 2004/0000133 A1 Jan. 1, 2004

(30) Foreign Application Priority Data

Mar. 16, 2002 (DE) ..... 102 11 817

(51) Int. Cl.[7] ..... D01H 4/08
(52) U.S. Cl. ..... 57/407; 57/404
(58) Field of Search ..... 57/404–417

(56) References Cited

U.S. PATENT DOCUMENTS

| | | | | |
|---|---|---|---|---|
| 3,868,815 A | | 3/1975 | Stahlecker | 57/88 |
| 4,112,659 A | | 9/1978 | Stahlecker et al. | 57/58.89 |
| 4,265,083 A | * | 5/1981 | Braun et al. | 57/263 |
| 4,899,528 A | * | 2/1990 | Fahmuller et al. | 57/92 |
| 5,184,552 A | | 2/1993 | Ijichi | 101/348 |
| 5,584,170 A | * | 12/1996 | Stahlecker | 57/263 |
| 5,916,119 A | * | 6/1999 | Lovas et al. | 57/301 |
| 5,916,121 A | | 6/1999 | Wassenhoven | 57/408 |
| 6,321,521 B1 | * | 11/2001 | Burchert | 57/263 |

FOREIGN PATENT DOCUMENTS

| | | |
|---|---|---|
| DE | 21 41 276 B2 | 3/1973 |
| DE | 25 55 059 a1 | 6/1977 |
| DE | 39 42 402 A1 | 6/1991 |
| DE | 197 08 944 A1 | 9/1998 |

OTHER PUBLICATIONS

German Search Report.
European Search Report.

* cited by examiner

*Primary Examiner*—Gary L. Welch
*Assistant Examiner*—Shaun R Hurley
(74) *Attorney, Agent, or Firm*—Kennedy Covington Lobdell & Hickman, LLP

(57) ABSTRACT

A spinning device comprising a spinning box housing; a spinning rotor having a spinning cup on a rotor shaft; a cover element; a traveling belt acting tangentially on the rotor shaft; a rotor brake; a pivotable expander roller moveable within a maximum pivot angle via a pressure lever system connected to the brake gear of the rotor brake between an operative position when the spinning box is closed in an inoperative position wherein the expander roller is automatically lifted off the tangential belt and the rotor brake is applied to the rotor shaft when the spinning box is opened; a brake and locking lever having a locking recess in contact with an arresting roller arranged on the cover element; and an arrangement in the pressure lever system for absorbing shock-like forces acting on the expander roller and for preventing the forces from being transmitted to the brake and locking lever.

10 Claims, 5 Drawing Sheets

SPINNING DEVICE

CROSS-REFERENCES TO RELATED APPLICATIONS

This application claims the benefit of German patent application 10211817.5 filed Mar. 16, 2002, herein incorporated by reference.

FIELD OF THE INVENTION

The present invention relates generally to spinning devices, and more particularly to spinning devices for open-end rotor spinning machines.

BACKGROUND OF THE INVENTION

Spinning devices for open-end rotor spinning machines are known.

For example, German Patent Publication DE 197 08 944 A1 discloses an open-end spinning machine with a spinning rotor, having a rotor shaft supported on a support disk bearing and a rotor cup that rotates in a rotor housing, that can be closed by means of a cover element and can be charged with a vacuum.

German Patent Publication DE 39 42 402 C2 discloses a similar spinning device. With this known spinning device, the rotor shaft of the rotor is also rotatably seated in two wedge gaps of a support disk bearing, and a tangential belt extending over the length of the machine acts on it. In this case the tangential belt simultaneously drives all spinning rotors of a side of the machine.

On the side opposite the wedge gaps, an expander roller is assigned to each rotor shaft that loads the tangential belt in the direction of the rotor shaft. The expander roller is seated, freely rotatable on a shaft of a two-armed expander roller holder that is pivotable around an axis extending parallel with respect to the axis of rotation of the expander roller and is loaded by means of a spring element. Moreover, the expander roller holder is connected via a pressure lever system with an actuating lever that when acted upon during the run-up of the spinning rotor results in an increase of the pressure force of the tangential belt against the respective rotor shaft.

This known spinning device has a pincer-like rotor brake, the ends of whose pincer arms are equipped with brake linings. The pincer arms are maintained in the opened state by a hoop spring or the like and can be applied to the rotor shaft by means of a brake gear.

Here, the rotor brake and the expander roller are connected via a common actuating mechanism in such a way that when the spinning device is opened, i.e. when the cover element is pivoted away from the rotor housing, the expander roller is automatically lifted off the tangential belt against the force of the spring element resting on it, and the rotor brake is closed. In this way the spinning rotor is dependably braked to a stop.

The above described spinning devices have been in actual use and have been employed in large numbers in the textile industry for quite a while.

However, under rare exceptional conditions, for example in the case of a defect in the tangential belt or unbalanced rotation of a spinning rotor, it can happen that the spinning device is charged with internal forces which, for example, results in the expander roller suddenly jumping up. In rare cases these internal forces can lead to the spinning device being opened before the spinning rotor has stopped which is not without danger for the operators.

SUMMARY OF THE INVENTION

It is accordingly an object of the present invention to provide a spinning device in which the unintentional opening of the spinning device is dependably prevented under any circumstances. This object is addressed by providing a spinning device comprising a spinning box housing fixable on a base frame of a textile machine and supporting a rotor housing; a spinning rotor having a spinning cup on a rotor shaft supported in bearing nips of a support disk bearing for rotation of the rotor during spinning at a high number of revolutions in the rotor housing, a cover element for closing and opening the rotor housing, an arrangement for charging the rotor housing with a vacuum; a traveling belt acting tangentially on the rotor shaft, a rotor brake having a brake gear; a pivotable expander roller moveable within a maximum pivot angle via a pressure lever system connected to the brake gear of the rotor brake between an operative position when the spinning box is closed in an inoperative position wherein the expander roller is automatically lifted off the tangential belt and the rotor brake is applied to the rotor shaft when the spinning box is opened, a brake and locking lever having a locking recess in contact with an arresting roller arranged on the cover element; and an arrangement in the pressure lever system for absorbing shock-like forces acting on the expander roller and for preventing the forces from being transmitted to the brake and locking lever.

The spinning device of the present invention has the particular advantage that its cover element is positively locked. This lock can only be opened from the outside and, after opening, it is assured that the spinning rotor no longer rotates.

Thus, an advantage of the present invention is that it is assured that the spinning device is not inadvertently opened by internal forces, even in case of possible malfunctions.

In a preferred embodiment of the present invention, a device is provided in the area of a cross arm of the spinning box housing which makes it possible to preset the maximum pivot angle of the expander roller. In case of a malfunction, such a travel limiting device prevents the expander roller from being flipped upward past a predetermined amount and, in the course of this movement, from also lifting the brake and locking lever positively fixing the spinning device in place, out of its locked position.

Furthermore, such a travel limiting device assures that a flipped-up expander roller cannot damage either the spinning device itself or adjacent components of the spinning device.

A travel limiting device can be simply produced as follows. An elongated hole recess arranged in a cross arm of the spinning box housing is placed and dimensioned in such a way that the freedom of movement of the lifting hoop for actuating the expander roller and guided in the elongated hole recess is minimized. Since the lifting hoop is connected to the pivotably seated expander roller holder, it is relatively simple to preset the pivot angle of the expander roller.

However, in an advantageous manner, a limitation of the pivot angle can also be achieved. For example, a special detent element is positioned in the area of the elongated hole recess. Such a detent element is seated, for example, on the connecting shaft of the lifting hoop/expander roller holder and extends with a guide pin into the elongated hole recess. The pivot angle of the expander roller can also be effectively limited by such a detent element.

Another advantageous embodiment of the present invention is where a lifting hoop of the expander roller, connected via a connecting means to a pressure increasing lever, is connected via an arrangement having an elongated hole guide with the brake and locking lever such that the arrangement and length of the elongated hole guide arranged on the brake and locking lever is selected to be such that no forces are transmitted to the brake and locking lever from the expander roller. This embodiment makes, on the one hand, a dependable triggering of the expander roller possible in case of need and, on the other hand, assures that the spinning device cannot be opened by internal forces.

In the course of the acceleration of the spinning rotor during the resumption of spinning by the spinning device it is possible, on the one hand, to increase the pressure force of the tangential belt against the rotor shaft by means of the pressure increasing lever but, on the other hand, for example in case of damage to the rotor or tangential belt, the described arrangement prevents the unlocking of the spinning device and its opening while the rotor is running.

Another embodiment of the present invention includes an arrangement that has a strip arranged on the back of the brake and locking lever and resting on the connecting means. Still yet another embodiment of the present invention includes an arrangement inserted into the lifting hoop allowing pressure to be applied to the expander roller via the pressure increasing lever, but compensating in an opposite direction a transmission at least of shock-like introduced forces to the brake and locking lever.

As an alternative to the above embodiments that relate to the linkage area of the pressure increasing lever/brake and locking lever/lifting hoop, the present invention also encompasses an embodiment in which a device absorbs shocks being passed on to the associated lifting hoop, for example, when an expander roller is flipped up.

Such an arrangement at least absorbs shock-like occurring forces and in this way prevents their being passed on to the brake and locking lever.

In yet another embodiment of the present invention, the lifting hoop is preferably embodied in two parts, and the two hoop elements are connected by means of a non-positively operating coupling device.

In case of shock-like occurring forces, the lifting hoop is shortened without it being possible in this case to transmit forces to the brake and locking lever.

The coupling device is comprised of, for example, a plastic element having spring-loaded arresting tongues. The arresting tongues act together with corresponding sliding faces on one of the two hoop elements.

By means of the shape and arrangement of the arresting tongues, as well as of the associated sliding faces on the hoop element, it is possible here to determine at which size of a shock a relative movement of the hoop element occurs as well as to assure that the expander roller can be acted upon by the pressure increasing lever.

A further embodiment of the present invention provides that an additional lever is fixed on the brake and locking lever that has a catch for the positive reception of the locking roller arranged on the cover element. Such an embodiment also represents a dependable and simple arrestment of the cover element in its locked position.

Further details of the invention can be gathered from a non-limiting exemplary embodiment presented in the following description with reference made to the drawings.

DESCRIPTION OF THE PREFERRED EMBODIMENT

Figure 1:
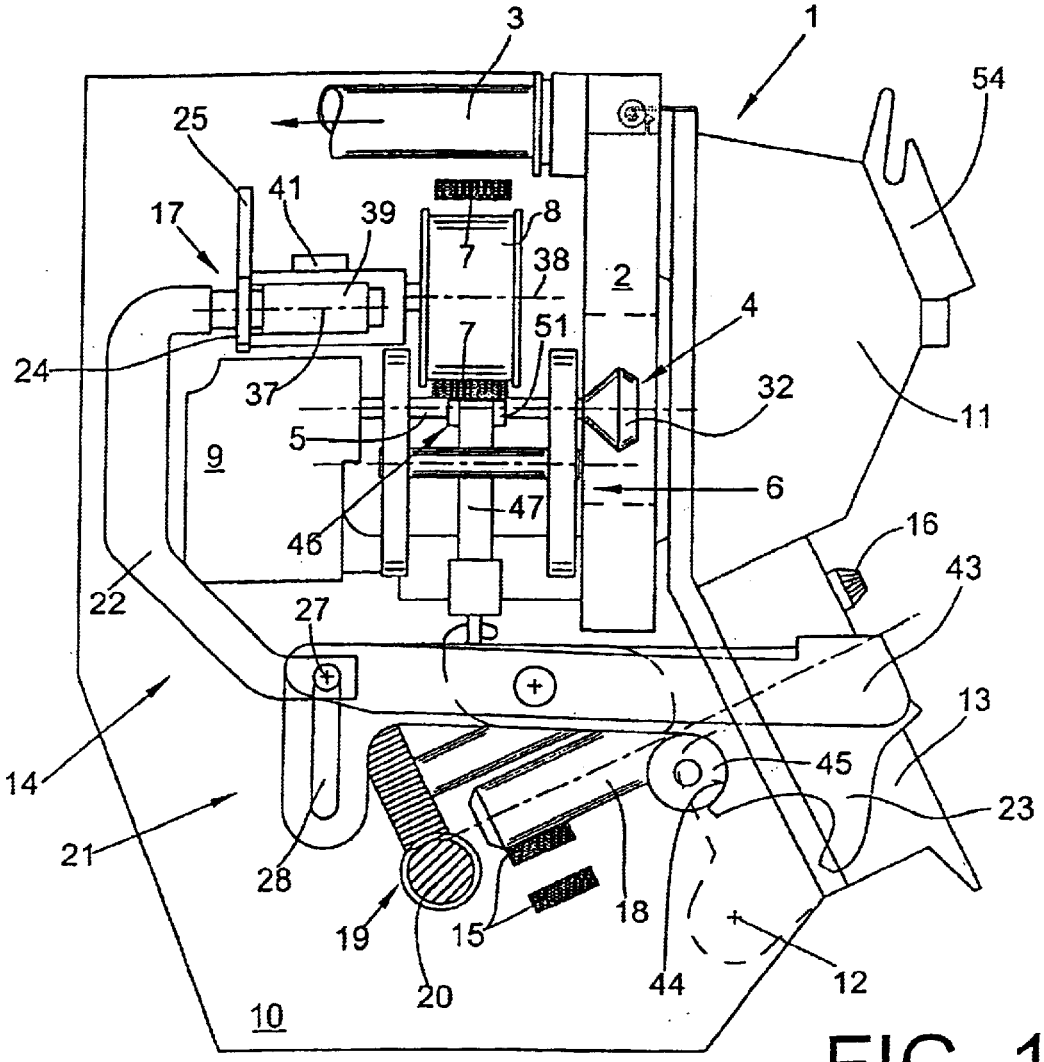
FIG. 1 is a lateral view of an open-end rotor spinning device, wherein an arrangement has been inserted into the pressure lever system for the expander roller which prevents the transmission of forces via a lifting hoop to a brake and locking lever.

An open-end spinning device 1 is shown schematically and in a lateral view in FIG. 1. In FIG. 1, the open-end spinning device 1 is shown in a state ready for operation, meaning that the rotor housing 2, in which the spinning cup 32 of a spinning rotor 4 turns at a high number of revolutions, is closed by a cover element 11.

In this embodiment, the rotor housing 2 is connected in a known manner by means of a pneumatic line 3 to a vacuum source (not shown). The vacuum is needed for spinning.

In a customary manner, the rotor shaft 5 of the spinning rotor 4 is seated in the wedge gaps of a support disk bearing 6 and is driven by a tangential belt 7 that extends over the length of the machine and in turn is acted upon by an expander roller 8 in the area of the rotor shaft 5.

The spinning rotor 4 is further supported in the axial direction by an appropriate axial bearing 9, such as a permanent magnet bearing.

In this embodiment, the rotor housing, as well as the bearing devices 6 and 9 are fixed in place on the spinning box housing 10, which in turn is fastened on the base frame of the textile machine (not shown).

The rotor housing 2, per se open toward the front, can be closed by means of a so-called conduit plate arranged in a pivotably seated cover element 11.

The cover element 11 is connected with the spinning box housing 10 via a pivot shaft 12. Furthermore, a sliver opening device is integrated into the cover element 11. The sliver opening device in a known manner substantially comprises an opening roller rotating in an opening roller housing 13, a sliver draw-in cylinder 16, and an associated sliver compressor.

The opening roller is driven by a tangential belt 15 that rests against the drive wharve 18 of the opening roller, while the driving of the sliver draw-in cylinder 16 is performed via a driveshaft 20 extending over the length of the machine, or an appropriate worm/worm wheel arrangement 19.

An expander roller 8 is assigned to each rotor shaft 5 that acts upon the tangential belt 7 in the immediate vicinity of the rotor shaft 5.

As shown in the figures, the expander roller 8 is seated, freely rotatable, on a shaft 38 of an expander roller holder 39, that can be pivoted around a shaft 40 extending parallel with the rotor shaft 5. A spring element 41, preferably a leaf spring, acts on the expander roller holder 39, which presses the expander roller 8 against the tangential belt 7.

Furthermore, a lifting hoop 22 of a pressure lever system 14 is connected to the expander roller holder 39 by means of a shaft 37. The lifting hoop 22 has numerous embodiments. The lifting hoop 22 passes through an elongated hole recess 24 in a cross arm 25 of the spinning box housing 10 and is connected on its opposite side to a so-called pressure increasing lever 43 via a connecting means 27.

In this embodiment, the connecting means 27 simultaneous acts together with a special guide and transfer element arranged on the brake and locking lever 23. This guide and transfer element arranged at the end of the brake and locking lever 23 has different embodiments.

Figure 2:
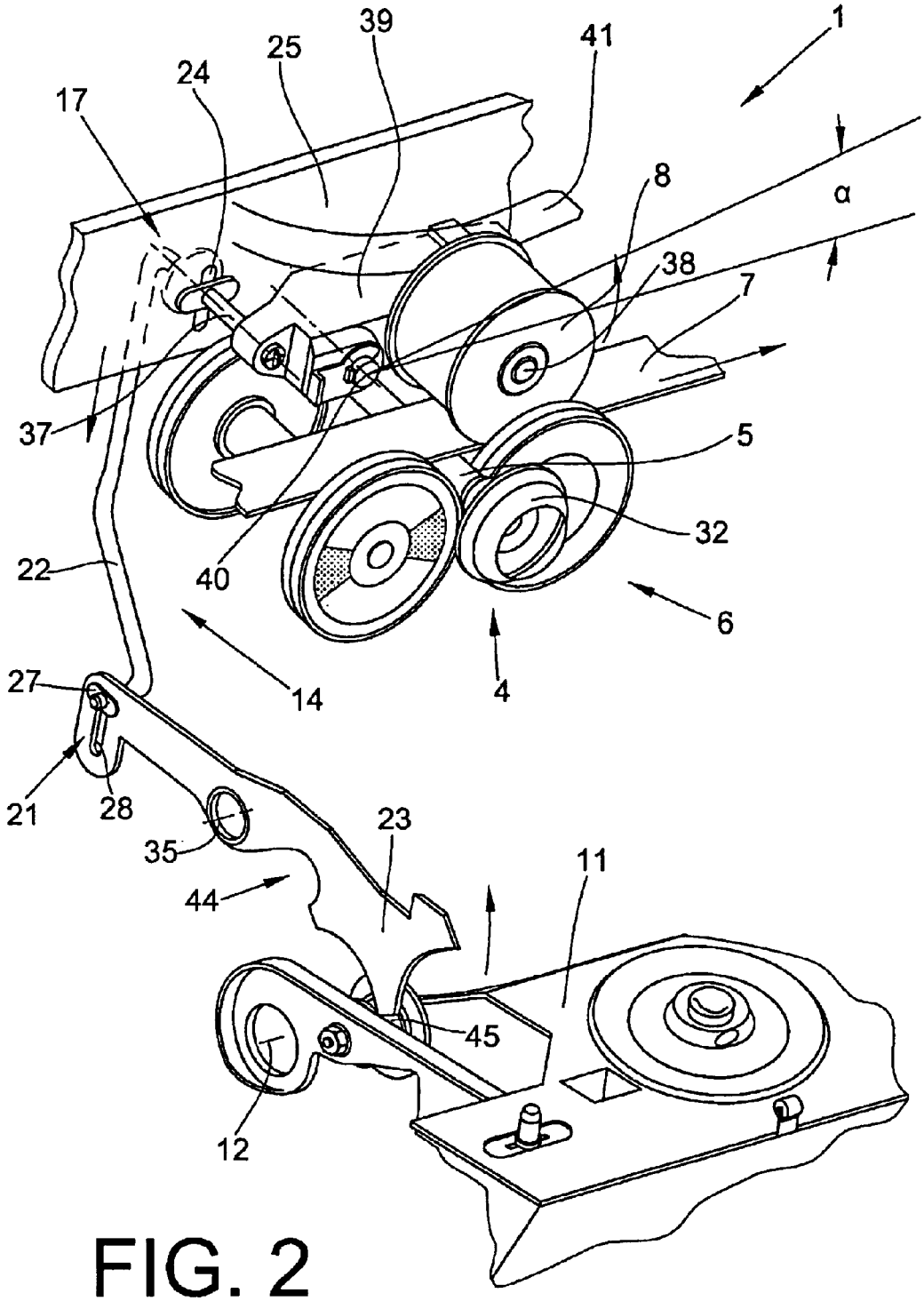
FIG. 2 is a perspective plan view of an opened open-end rotor spinning device with an arrangement for absorbing internal forces and inserted into a comparable pressure lever system.

The guide and transfer element can be embodied as an elongated hole guide 28, as shown by way of example in FIGS. 1 and 2.

Figure 1A:
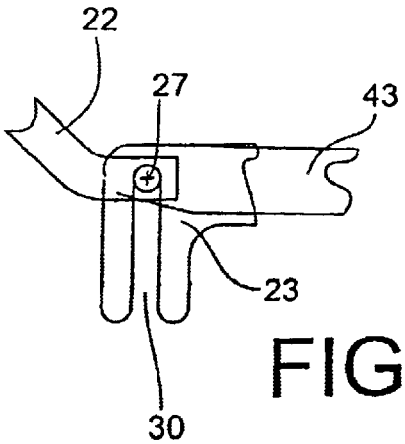
FIG. 1A, is an enlarged view of the arrangement inserted into the pressure lever system.

In accordance with FIG. 1A, the brake and locking lever 23 has on its end a fork guide element 30, open at the bottom, as the guide and transfer element, in which the connecting means 27, that connects the lifting hoop 22 with the pressure increasing lever 43, is guided.

Figure 1B:
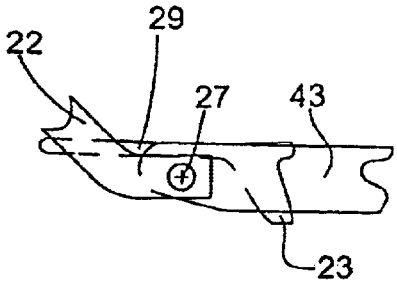
FIG. 1B is an enlarged view of the arrangement inserted into the pressure lever system and located in the connecting area between the lifting hoop/pressure increasing lever/brake and locking lever.

FIG. 1B shows a brake and locking lever 23 wherein the guide and transfer element is embodied as a strip-like extension. This strip 29 rests on the connecting means 27 from above.

Together with the guide and transfer element, the connecting means 27 constitutes an arrangement 21 on the brake and locking lever 23, that prevents the transfer of forces from the lifting hoop 22 to the brake and locking lever 23.

The arrangement 21 prevents forces from being transmitted via the lifting hoop 22 to the brake and locking lever 23 which could lead to the lifting of the brake and locking lever 23, and therefore to a release of the arresting roller 45 of the cover element 11.

In a customary manner, a rotor brake 46 is assigned to the rotor shaft 5 of the spinning rotor 4, which is arranged underneath the tangential belt 7. Preferably, the rotor brake 46 has two pivotably seated pincer arms 47, 48, which are pushed apart by means of a spreading spring.

In this embodiment, the pincer arms 47, 48 each have a brake lining 51, 52 on their end areas, or a sliding face on the opposite side.

In a known manner and therefore not represented in detail, a roller is seated in the area of the convergently arranged, sliding faces between the legs of a U-shaped brake beam 33, and can be vertically displaced in relation to the sliding faces and in the process places the brake linings 51, 52 of the rotor brake 46 against the rotor shaft 5.

In a known manner, the rotor brake 46 and the expander roller 8 are connected with each other via a common activating mechanism in such a way that, when the spinning device is opened, i.e. in the course of the backward swing of the cover element 11, the expander roller 8 is lifted off the tangential belt 7 against the force of the spring element 41, and the brake linings 51, 52 are simultaneously applied to the rotor shaft 5.

Figure 3:
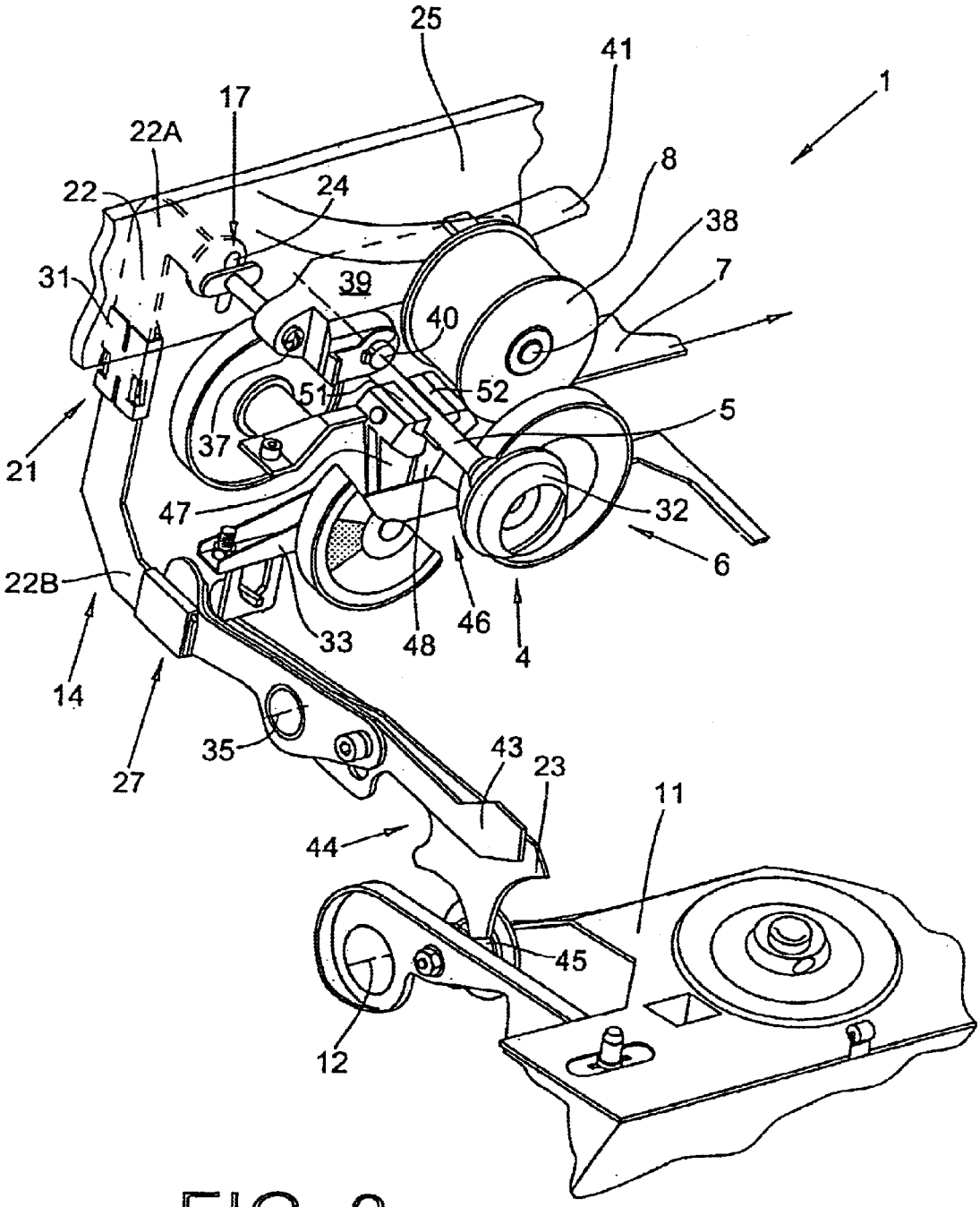
FIG. 3 is a perspective plan view of an arrangement as in FIG. 2 inserted into the pressure lever system of an expander roller, in particular the lifting hoop.

As can be seen in FIGS. 1 to 3, the brake and locking lever 23 has a locking recess 44, in which an arresting roller 45 arranged on the cover element 11 is positively fixed in place when the cover element 11 is closed.

An advantageous embodiment of the present invention is represented in FIGS. 1 and 2 in a perspective plan view. Although different spinning devices are represented in the two drawing figures, these spinning devices do not differ in principle, so that components with the same reference numerals are identical in function.

The brake and locking lever 23 has a locking recess 44, in which an arresting roller 45 arranged on the cover element 11 is positively fixed in place when the cover element 11 is closed.

The brake and locking lever 23 is pivotably seated on a shaft 35 and has on its end an elongated hole guide 28, for example.

A connecting means 27 slides in the elongated hole guide 28 and connects the lifting hoop 22 with the pressure increasing lever 43.

The elongated hole guide 28 of the brake and locking lever 23 constitutes a type of "idling arrangement" 21. The elongated hole guide 28 is arranged and dimensioned in such a way that on the one hand, as indicated in FIG. 2, when the spinning device is opened, the expander roller 8 is dependably lifted off the tangential belt 7 by the lifting hoop 22 and the rotor brake 46 is actuated, but on the other hand no forces can be transmitted from the expander roller 8 to the brake and locking lever 23.

It can be seen that the lifting hoop 22 is connected by means of a shaft 37 to the expander roller holder 39 which, in turn, is seated pivotably movable around a shaft 40, and a shaft 38 supports the freely rotatably seated expander roller 8.

The lifting hoop 22 further passes through an elongated hole recess 24 in a cross arm 25 of the spinning box frame 10. In this embodiment, the elongated hole recess 24 is arranged and embodied in such a way that it constitutes a travel limiting means 17, which prevents the expander roller 8 from being lifted over more than a maximum pivot angle $\alpha$.

Figure 5:
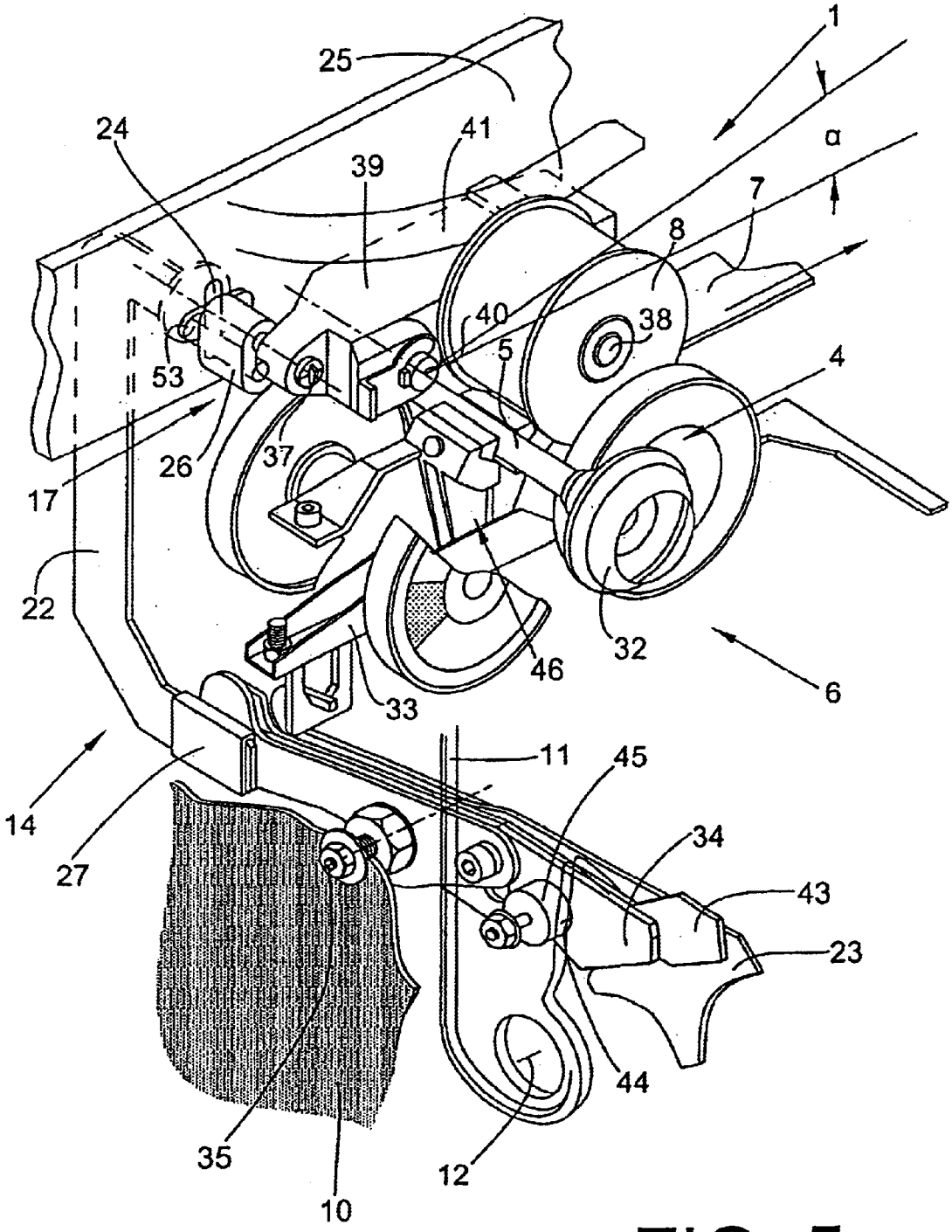
FIG. 5 is a perspective plan view of an alternative arrangement of the present invention.

A detent element 26 can also be provided as the travel limiting means 17. As can be seen in FIG. 5, this detent element 26 is seated on the shaft 37 of the lifting hoop 22 and slides with a guide pin 53 in the elongated hole recess 24 of the cross arm 25.

A further embodiment of a device for preventing the transmission of internal forces to the brake and locking lever 23 is represented in FIG. 3. Here, a coupling arrangement 31 is present in place of the idling arrangement 21. A coupling clip 49 has been inserted into a two-piece lifting hoop 22, which non-positively connects the hoop elements 22A and 22B.

Figure 4:
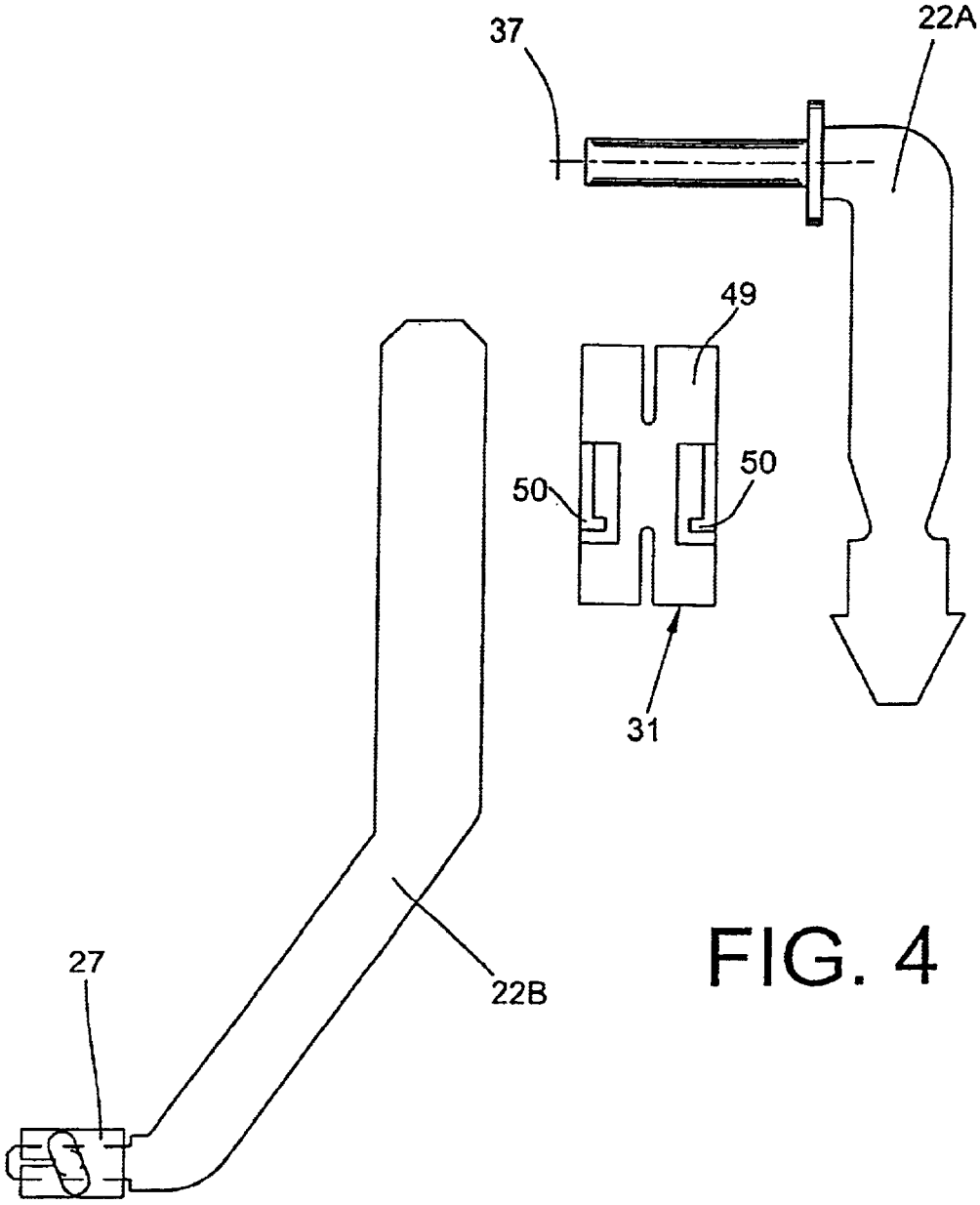
FIG. 4 is an exploded view of an arrangement in accordance with FIG. 3 in detail.

As can be seen in FIG. 4 in particular, the upper hoop element 22A of the lifting hoop 22, which is connected by means of the shaft 37 to the expander roller holder 39, has two sliding faces, which extend divergingly upward. The sliding faces of the hoop element 22A act together with two spring-elastic arresting tongues 50 at the coupling clip 49 of the coupling arrangement 31.

The hoop elements 22A and 22B are connected by means of the coupling clip 49 which, for example, is made of plastic, in such a way, that at least shock-like introduced forces lead to a relative displacement of the hoop elements 22A and 22B, and therefore to a shortening of the lifting hoop 22.

Forces, at least shock-like introduced forces, which have reached the lifting hoop 22 by way of the expander roller 8, are absorbed by this shortening of the lifting hoop 22, i.e. these forces are prevented from being transmitted to the brake and locking lever 23.

A further advantageous embodiment of the device in accordance with the present invention is represented in FIG. 5. In this embodiment, an additional lever 34 is fixed on the brake and locking lever 23, which has a locking recess 44 for the positive fixation of the arresting roller 45 arranged on the cover element 11.

If during the course of a spinning process, a disruption of the spinning process, such as due to a yarn break occurs at one of the open-end spinning devices, an automatically operating piecing unit, a so-called piecing cart, is positioned at the respective spinning frame.

The piecing cart opens the spinning frame and cleans at least the spinning rotor.

The piecing cart lifts the brake and locking lever 23 by means of an appropriate (not shown) manipulator. In the course of this, the locking recess 44 of the brake and locking lever 23 is lifted off the arresting roller 45 of the cover element 11, and the lifting hoop 22 of the pressure lever system 14 of the expander roller 8 is acted upon by the connecting means 27 in the sense of "lift off" expander roller 8. In the course of lifting the brake and locking lever 23, the brake beam 33 of the rotor brake 46 is simultaneously acted upon.

The rotor brake is actuated via the brake beam 33, and the spinning rotor 4 is braked to a stop.

By means of a so-called opening arm arranged on the piecing cart, that engages the opening element 54 of the cover element 11, the cover element 11 can be pivoted around the pivot shaft 12, and the spinning device can be opened in this way.

Subsequent to the piecing process which is a known process and therefore not explained in greater detail, when the spinning frame is again to be accelerated up to the operational number of revolutions, the piecing cart acts on the pressure increasing lever 43 with an appropriate device.

A force is exerted on the pressure increasing lever 43 that is transmitted via the connecting means 27 to the lifting hoop 22 and lifts the latter. As can be seen in particular in FIG. 2, the lifting hoop 22, which is connected via a shaft 37 to the expander roller holder 39, in the process transmits a torque to the expander roller holder 39, that is seated, pivotable around a shaft 40, that leads to the expander roller 8 being pressed against the tangential belt 7, and therefore to an increase of the friction between the tangential belt 7 and the rotor shaft 5 during the run-up of the spinning rotor 4.

If a serious malfunction should occur during the spinning process, in particular an event which leads to the expander roller 8 being suddenly upwardly accelerated, the device 17, 21, 31 prevents the transmission of forces to the brake and locking lever 23. With the device 17, 21, 31 of the present invention, it is assured that the cover element 11 of the spinning device 1 remains positively locked under all circumstances and cannot be opened by internal forces.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A spinning device comprising:

a spinning box housing fixable on a base frame of a textile machine and supporting a rotor housing, a spinning rotor having a spinning cup on a rotor shaft supported in bearing nips of a support disk bearing for rotation of the rotor during spinning at a high number of revolutions in the rotor housing, a cover element for closing and opening the rotor housing, an arrangement for charging the rotor housing with a vacuum, a traveling belt acting tangentially on the rotor shaft, a rotor brake having a brake gear, a pivotable expander roller movable within a maximum pivot angle via a pressure lever system connected to the brake gear of the rotor brake between an operative position when the spinning box is closed, and an inoperative position wherein the expander roller is automatically lifted off the tangential belt and the rotor brake is applied to the rotor shaft, when the spinning box is opened, a brake and locking lever having a locking recess in contact with an arresting roller arranged on the cover element, and an arrangement in the pressure lever system for absorbing shock-like forces acting on the expander roller and for preventing the forces from being transmitted to the brake and locking lever, wherein the spinning box housing comprises a travel limitation means in a cross arm of the spinning box housing, limiting the maximum pivot angle of the expander roller.

2. The spinning device in accordance with claim 1, wherein a lifting hoop passes through an elongated hole recess of the cross arm such that the elongated hole recess constitutes a travel limitation means to limit the pivot angle of the expander roller.

3. The spinning device in accordance with claim 2, wherein the travel limitation means is comprised of a detent element seated on a shaft of the lifting hoop and is guided with a guide pin in the elongated hole recess of the cross arm to limit the pivot angle of the expander roller.

4. The spinning device in accordance with claim 2, wherein the lifting hoop of the expander roller, connected via a connecting means to a pressure increasing lever, is connected via an arrangement having an elongated hole guide with the brake and locking lever, wherein the arrangement and length of the elongated hole guide arranged on the brake and locking lever is selected such that no forces are transmitted to the brake and locking lever from the expander roller.

5. The spinning device in accordance with claim 4, wherein the arrangement has a fork-like guide arranged on the brake and locking lever and is open toward the bottom, in which the connecting means are guided.

6. The spinning device in accordance with claim 5, wherein the arrangement has a strip arranged on the back of the brake and locking lever and resting on the connecting means.

7. The spinning device in accordance with claim 2, wherein an arrangement is inserted into the lifting hoop allowing pressure to be applied to the expander roller via the pressure increasing lever, but compensating in an opposite direction a transmission at least of shock-like introduced forces to the brake and locking lever.

8. The spinning device in accordance with claim 2, wherein the lifting hoop is comprised of two hoop elements connected via a non-positively operating coupling arrangement to shorten the lifting hoop.

9. The spinning device in accordance with claim 8, wherein the coupling arrangement has at least one spring-elastic arresting tongue acting together with a corresponding sliding face on one of the hoop elements.

10. The spinning device in accordance with claim 1, wherein an additional lever with a locking recess for positive reception of the arresting roller arranged on the cover element is fixed on the brake and locking lever.

* * * * *